US010041368B2

(12) United States Patent
Homer

(10) Patent No.: US 10,041,368 B2
(45) Date of Patent: Aug. 7, 2018

(54) TURBINE ASSEMBLY

(71) Applicant: ALSTOM Technology Ltd, Baden (CH)

(72) Inventor: Christopher John Homer, Rugby (GB)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 546 days.

(21) Appl. No.: 14/881,484

(22) Filed: Oct. 13, 2015

(65) Prior Publication Data

US 2016/0115815 A1 Apr. 28, 2016

(30) Foreign Application Priority Data

Oct. 22, 2014 (EP) ..... 14189908

(51) Int. Cl.

| | |
|---|---|
| ***F01D 11/10*** | (2006.01) |
| ***F01D 11/08*** | (2006.01) |
| ***F01D 5/22*** | (2006.01) |
| ***F01D 25/24*** | (2006.01) |
| ***F01D 1/04*** | (2006.01) |

(52) U.S. Cl.

CPC ..... *F01D 11/08* (2013.01); *F01D 1/04* (2013.01); *F01D 5/225* (2013.01); *F01D 11/10* (2013.01); *F01D 25/246* (2013.01)

(58) Field of Classification Search

CPC . F01D 11/08; F01D 11/10; F01D 1/04; F01D 5/225; F01D 25/246

See application file for complete search history.

(56) References Cited

U.S. PATENT DOCUMENTS

| | | | | |
|---|---|---|---|---|
| 2,291,828 A * | 8/1942 | New | F01D 5/145 415/115 |
| 4,146,352 A * | 3/1979 | Yasugahira | F01D 5/145 415/144 |
| 8,668,439 B2 * | 3/2014 | Willett, Jr. | F01D 5/084 415/116 |
| 2013/0323019 A1 | 12/2013 | Mitchell | |

FOREIGN PATENT DOCUMENTS

| | | | |
|---|---|---|---|
| DE | 195 24 984 A1 | 1/1997 | |
| DE | 19524984 A1 * | 1/1997 | F01D 5/142 |

* cited by examiner

*Primary Examiner* — Woody Lee, Jr.
(74) *Attorney, Agent, or Firm* — GE Global Patent Operation; Cynthia W. Flanigan

(57) ABSTRACT

The invention relates to a turbine in which a bypass-passage extends through a base member of a stationary vane to join seal cavities of adjacent rotating blade rows so that seal flow passing between a casing and shrouds of the rotating blades at least partially bypasses the turbine main flow passage.

15 Claims, 2 Drawing Sheets

TURBINE ASSEMBLY

CROSS-REFERENCE TO RELATED APPLICATIONS

This application claims priority to European Patent Application 14189908.8 filed Oct. 22, 2014, the contents of which are hereby incorporated in its entirety.

TECHNICAL FIELD

The present disclosure relates generally to multi stage turbines, including steam turbines and gas turbines and more specifically to means to reduce efficiency loss caused by leakage flow through seals of shrouded rotating blades.

BACKGROUND INFORMATION

An axial flow turbine, for example a steam turbine, comprises a casing and a rotor which is rotatably supported within the casing. The rotor comprises a shaft and a plurality of rotor blade rings which are attached behind one another to the shaft. During operation of the turbine working fluid is expanded progressively by the blade rings to bring about driving the shaft.

Each rotor blade ring is formed by a plurality of rotor blades being circumferentially arranged, wherein two adjacent rotor blades form a blade passage. The rotor blades are aerodynamically profiled such that, when the working fluid passes the blade passages, the flow is turned and thereby a circumferential force on the rotor blades is generated. The circumferential forces on each blade of the rotor blade ring effect turning the rotor thereby generating shaft power.

The rotor blades are fixed to the shaft and extend therefrom towards the casing. The lateral ends of the rotor blades at the casing are formed into blade tips, wherein at the blade tips the rotor blade ring is shrouded by a shroud. The shroud is fixed to the blade tips and spaced apart from the casing thereby forming a tip clearance. The height of the tip clearance is dimensioned such that during operation of the turbine it is prevented that the shroud scrubs at the casing. Due to the fact that static pressure of the flow upstream of the rotor blade ring is higher than static pressure of the flow downstream of the rotor blade ring, during operation of the turbine a leakage flow passes the tip clearance.

The main flow passes the blade passages for shaft power generation, whereas the leakage flow bypasses the rotor blade ring via the tip clearance. Therefore, the leakage flow does not participate to the shaft power generation and does not flow through the blade passage. Further, the leakage flow after being re-entrained into the main flow path interferes with the main flow. Therefore, the main flow is locally inhomogeneous resulting in a mismatched flow. Furthermore, the tip clearance flow mixes with the main flow and generates disadvantageous dissipation. As consequence of this, the presence of the tip clearance flow affects the turbine efficiency.

In particular in high pressure turbines with low aspect ratio blades, the loss caused by the tip clearance flow is significantly high compared with the total losses of the turbine.

A remedy to reduce this negative effect of the tip clearance flow on the aerodynamic efficiency of the turbine is to take measurements reducing the tip clearance flow. A measurement, for example, is to provide a labyrinth seal on the outer circumference of the shroud within the tip clearance in order to reduce the mass flow of the tip clearance flow. As an alternative, a sealing element is fixed at the casing in the tip clearance. For fixing the sealing element to the casing, in the casing a circumferential groove is provided into which the sealing element is mortised.

Each of the solutions reduces tip leakage but does not eliminate the flow. As a result there is a continuing need to address turbine efficiency losses resulting from blade tip leakage.

SUMMARY

A turbine is disclosed that is configured to address the problem of rotating blade leakage flow reducing turbine efficiency by creating turbulence in the main working fluid flow passage.

It attempts to addresses this problem by means of the subject matter of the independent claim. Advantageous embodiments are given in the dependent claims.

The disclosure is based on the general idea of providing a bypass around the stationary vanes in order to at least reduce the re-entry flow of the leakage fluid passing between shrouded rotating blade tips and the casing.

One general aspect includes a turbine comprising a rotor with a rotational axis, a casing enclosing a rotor to form a flow passage therebetween having first and second sealing means. The turbine also includes a first rotating blade row in the flow passage having a plurality of circumferentially distributed first blades each with a first root connected to the rotor and a first shroud adjacent the first sealing means. The turbine additionally has a stationary vane row, each that with vane airfoil that extends into the flow passage. The stationary vane row is axially adjacent and downstream of the first rotating blade row having a plurality of circumferential distributed stationary vanes. Each of the stationary vanes has a base member connected to the casing. A second rotating blade row is located in the flow passage axially adjacent and downstream of the stationary vane row. This second rotating blade row has a plurality of circumferentially distributed second rotating blades each with a second root connected to the rotor and a second shroud adjacent the second sealing means. A first cavity is formed by the first shroud, the first sealing means and the base member while a second cavity is formed by the second shroud, base member and the second sealing means.

Further aspects may include one or more of the following features. The turbine wherein each stationary vane has a leading edge wherein the first end of the bypass-passage is located at a point of the first cavity circumferentially between the leading edges of two circumferentially adjacent stationary vanes. The turbine wherein the bypass-passage is radially displaced from the rotor rotational axis. The turbine wherein the bypass-passage is parallel to the rotor rotational axis. The turbine wherein the bypass-passage is angled from the rotational axis in a direction to the normal operating rotation of the rotor of between −30 degrees and 30 degrees, preferably between 0 degrees and 10 degrees. The turbine wherein the bypass-passage has a uniform cross sectional area along its length. The turbine configured as a gas turbine, or impulse type steam turbine. The turbine wherein the base member is a steam turbine diaphragm.

In a general aspect the turbine of claim comprising a plurality of bypass-passages.

Other aspects and advantages of the present disclosure will become apparent from the following description, taken in connection with the accompanying drawings which by way of example illustrate exemplary embodiments of the present invention.

BRIEF DESCRIPTION OF THE DRAWINGS

By way of example, an embodiment of the present disclosure is described more fully hereinafter with reference to the accompanying drawings, in which.

DETAILED DESCRIPTION

Figure 1:
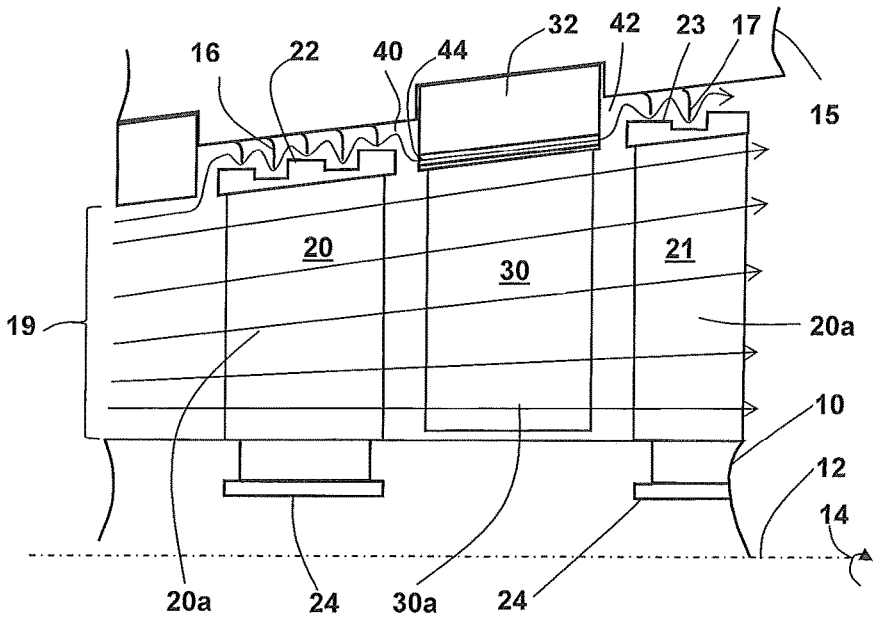
FIG. 1 is a perspective view of a turbine section with a bypass-passage according to an exemplary preferred embodiment of the disclosure.

Exemplary embodiments of the present disclosure are now described with references to the drawings, wherein like reference numerals are used to refer to like elements throughout. In the following description, for purposes of explanation, numerous specific details are set forth to provide a thorough understanding of the disclosure. However, the present disclosure may be practiced without these specific details, and is not limited to the exemplary embodiments disclosed herein.

Pitch is the distance in the direction of rotation between corresponding points on adjacent blades. In this description, the points correspond to the leading edge of circumferentially adjacent stationary blades wherein 0% pitch corresponds to the leading edge of the upstream blade as taken from the circumferential direction of rotation of the rotating blades of the turbine and 100% pitch corresponds to the leading edge of the downstream blade as taken from the circumferential direction of rotation of the rotating blades of the turbine.

An exemplary embodiment of a turbine shown in FIG. 1 includes a rotor 10 and a casing 15 enclosing the rotor 10 so as to form a flow passage 19 therebetween. A plurality airfoils 20*a*,30*a* of circumferentially distributed rotating blades 20 and stationary vanes 30 are located in the flow passage 19. The rotating blades 20 and stationary vanes 30 are arranged such that there is an upstream row of rotating blades 20 adjacent a downstream row of stationary vanes 30 which are in turn adjacent a further row of rotating blades 21. The number of rotating blades 20 and stationary vanes 30 shown in FIG. 1 is only limited in order to explain an exemplary embodiment and therefore is not a limiting example of a turbine to which exemplary embodiments of this disclosure can be applied.

Figure 2:
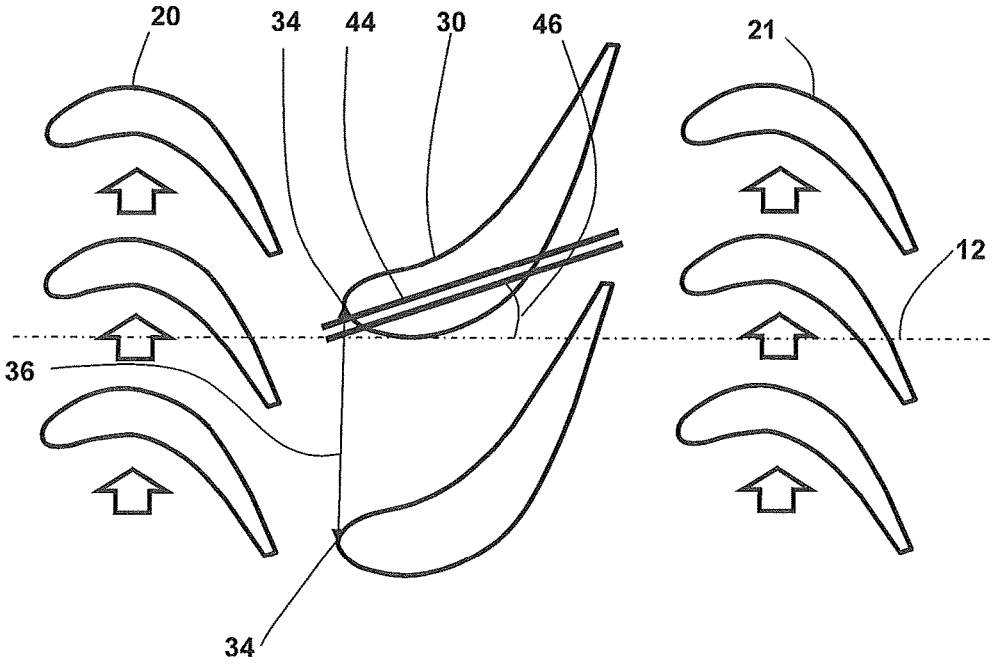
FIG. 2 is a top sectional view of the turbine section of FIG. 1.

The turbine includes sealing means 16, 17 that provide a seal between the stationary casing 15 and the shrouds 22, 23 of the rotating blades 20, 21. Depending on the configuration of the turbine, the sealing means 16, 17 could be mounted on the casing 15, as shown in FIG. 2, or else mounted on an extension ring 18*a*, 18*b* such that each of the seal means 16, 17 are in a first cavity 40 and a second cavity 42 respectively that are both located outside the flow path 19. In an exemplary embodiment shown in FIG. 3 an extension ring 18*a*, 18*b* is mounted to a downstream base member 32. In an exemplary embodiment shown in FIG. 3 an extension ring 18*a* is mounted to the base member 32 and an extension ring 18*b* is mounted to a downstream base member 32. In a not shown exemplary embodiment an extension ring 18*a* is mounted to an upstream base member 32.

Each of the rotating blades 20, 21 includes a blade root 24 that fixes the rotating blade 20, 21 to the rotor 10. At a distal end of each rotating blade 20, 21, that is, at an end nearest the casing 15, the rotating blades 20, 21 have a shroud 22, 23. The shroud 22, 23 is configured such that there is a leakage flow of working fluid that passes between the shroud 22, 23 and the casing 15. A sealing means, typically located between the casing 15 and the shroud 22, 23, limits the leakage flow.

The stationary vanes 30, located between the rows of rotating blades 20, 21, each have a base member 32 that supports or connects the stationary vane 30 to the casing 15. The form of the base member 32 is dependent on the configuration of turbine. For example, in an exemplary embodiment applied to an impulse type steam turbine, the base member 32 is a diaphragm 32 configured as a ring to support the stationary vanes 30 of the stationary vane row. In another not shown exemplary embodiment, the base member 32 is a vane root 32 connecting each stationary vane 30 to the casing 15. In another not shown exemplary embodiment, the base member is a combination of the casing 15 and a vane attachment means.

The first cavity 40 is formed by the first shroud 22, the first sealing means 16 and the base member 32 while the second cavity 42 is formed by the second shroud 23, base member 32 and the second sealing means 17.

An exemplary embodiment shown in FIG. 1 further includes a bypass-passage 44 that extends from a first end at the first cavity 40 through the base member 32 to a second end at the second cavity 42 wherein both the first end and the second are located outside of the flow passage 19. The purpose of the bypass-passage 44 is to direct leakage flow flowing over the shroud 22 of the upstream rotating blades 20 to the downstream row of rotating blades 21 by bypassing the flow passage 19 all together and thus bypass the airfoil 30*a* of the vane 30. As little or no leakage fluid from the first cavity 40 returns to the flow passage 19 a source of turbulence in the flow passage 19, and thus efficiency lost, is thus eliminated or at least reduced.

In an exemplary embodiment the bypass-passage 44 has a first end located at a point of the first cavity 40 circumferentially between the leading edges 34 of two circumferentially adjacent stationary vanes 30. In this exemplary embodiment circumferential between includes a point axially and/or radially displaced from a point on a line projected between leading edges 34 of two circumferentially adjacent stationary vanes 30. That is, the first end of the bypass-passage 44 may be at any point in the first cavity upstream of the projected line.

The configuration of the bypass-passage 44 is dependent on the type of turbine and whether or not the bypass-passage 44 is retrofitted to the turbine or else configured as part of the original design. As such it may be straight or else include at least one non-linear section, such as a curve or corner.

Figure 3:
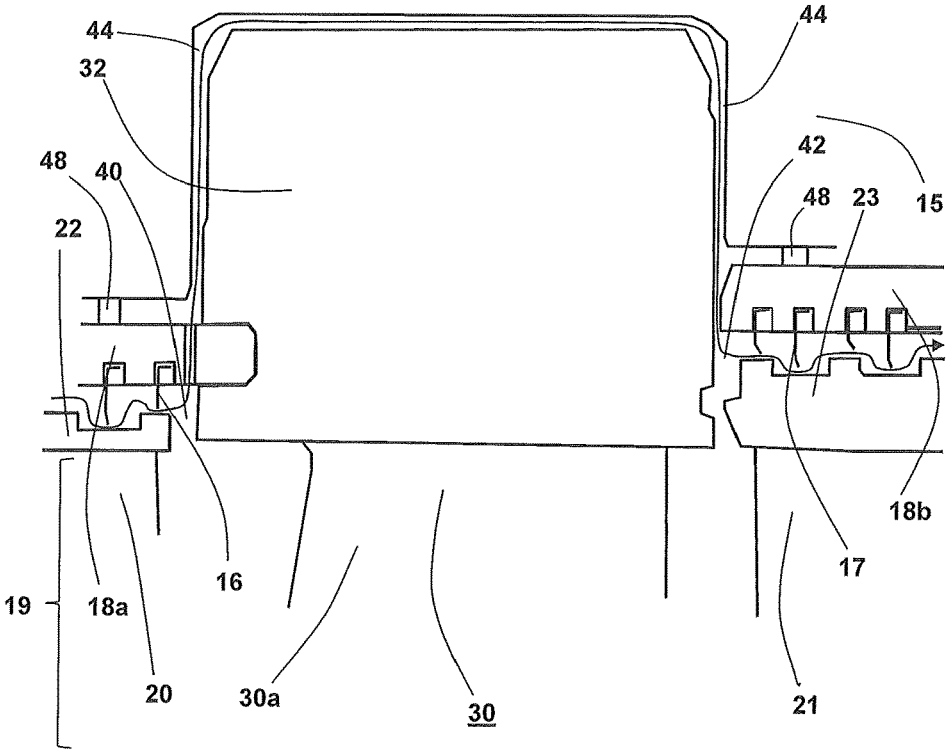
FIG. 3 is a sectional view of steam turbine with a diaphragm and bypass-passage of an exemplary embodiment around the diaphragm.

In an exemplary embodiment shown in FIG. 3 the turbine is an impulse type steam turbine with a diaphragm 32 configured as a ring to encircle and support stationary vanes 30 of the stationary blade row. In this exemplary embodiment, the bypass-passage 44 is formed through the diaphragm 32.

Figure 4:
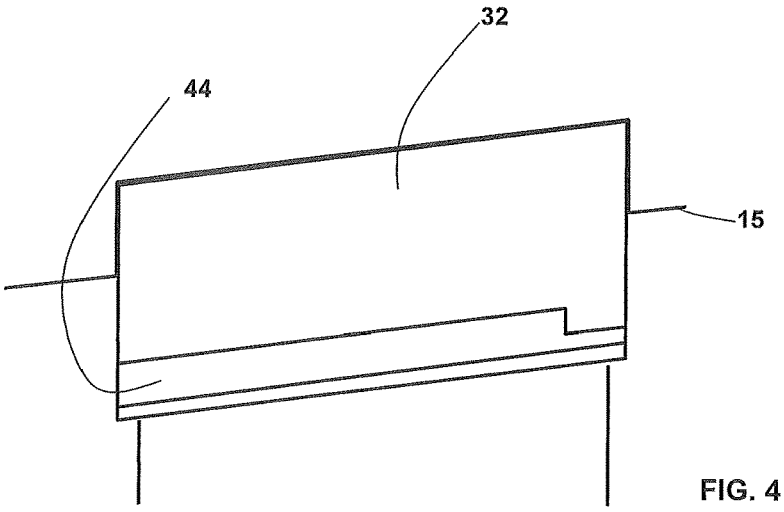
FIG. 4 is an expanded view of the base member of FIG. 1 showing a bypass-passage of non-uniform cross sectional area.

In an exemplary embodiment shown in FIG. 4, the bypass-passage 44 has different cross sectional areas along its length. In a first portion the bypass-passage 44 has a larger cross-sectional area while at an end region the bypass-passage 44 has a reduced cross-sectional area. This exemplary embodiment may be applicable for retrofits where it may be easier to drill long passages with a larger drill bit. This is enabled by the presence of a smaller pilot hole formed by the smaller cross-sectional area of the bypass-passage 44 that defines the flow capacity of the bypass-passage 44.

In an exemplary embodiment shown in FIG. 1 the flow passage 19 is skewed from the rotational axis 12 to preferably follow an expansion of the flow passage 19. In a not shown exemplary embodiment the flow passage 19 is parallel to the rotational axis 12.

In an exemplary embodiment shown in FIG. 2 the bypass-passage 44 forms an angle 46 with the rotational axis 12 that angles the bypass-passage 44 in the direction of rotational direction 14 of the rotating blades 20. In an exemplary embodiment shown in FIG. 2 the first end of the bypass-passage 44 is located along a pitch of the stationary vanes 30.

In an exemplary embodiment shown in FIG. 3 the turbine is an impulse type steam turbine with diaphragm 32 configured as a ring to support stationary vanes 30 of the a stationary blade row. In this exemplary embodiment, the bypass-passage 44 is formed around the diaphragm 32. When this exemplary embodiment is retrofitted to a steam turbine it may be necessary to ensure that steam does not further bypass the sealing means. Where the sealing means includes extension rings 18*a*, 18*b* each of which is itself mounted on the diaphragm 32 of this row of stationary vanes 30 or an adjacent row, additional casing seals 48 spanning between either or both of the extension rings 18*a*, 18*b* and the casing 15 may be required.

Although the disclosure has been herein shown and described in what is conceived to be the most practical exemplary embodiment, it can be embodied in other specific forms. For example, exemplary embodiments may equally be applied to gas turbines and all types of steam turbines including high pressure steam turbines, intermediate pressure steam turbines, reaction bladed steam turbines and impulse bladed steam turbines. The presently disclosed embodiments are therefore considered in all respects to be illustrative and not restricted. The scope of the disclosure is indicated by the appended claims rather that the foregoing description and all changes that come within the meaning and range and equivalences thereof are intended to be embraced therein.

The invention claimed is:

1. A turbine assembly comprising:

a rotor with a rotational axis;

a casing enclosing the rotor to form a flow passage therebetween;

a first rotating blade row having a plurality of circumferentially adjacent first rotating blades each with a first shroud, at a first rotating blade end that is distal from the rotor and blade airfoils extending into the flow passage;

a first sealing means located between the casing and the first shroud;

a stationary vane row axially adjacent and downstream of the first rotating blade row, having a plurality of circumferentially adjacent stationary vanes each with a base member and a vane airfoil extending into the flow passage;

a second rotating blade row in the flow passage axially adjacent and downstream of the stationary vane row having a plurality of circumferentially adjacent second rotating blades each with a second shroud, at a second rotating blade end that is distal from the rotor; and a second sealing means located between the casing and the second shroud, wherein a first cavity is formed by the first shroud, the sealing means and the base member and a second cavity is formed by the second shroud, the base member and the second sealing means, and a bypass-passage extending from a first end at the first cavity to a second end at the second cavity so as to bypass the flow passage and the vane airfoil.

2. The turbine assembly of claim 1, wherein each of the vane airfoils has a leading edge wherein the first end of the bypass-passage is located at a point of the first cavity circumferentially between the leading edges of two of the circumferentially adjacent vanes airfoils.

3. The turbine assembly of claim 1, wherein the bypass-passage is radially displaced from rotational axis.

4. The turbine assembly of claim 1, wherein the bypass-passage is parallel to the rotational axis.

5. The turbine assembly of claim 1, wherein the bypass-passage is angled from the rotational axis in a direction of a normal rotational direction of the rotor of between −30 degrees and 30 degrees.

6. The turbine assembly of claim 1, wherein the bypass-passage is angled from the rotational axis in a direction of a normal rotational direction of the rotor between 0 degrees and 10 degrees.

7. The turbine assembly of claim 1, wherein the first end of the bypass-passage has a larger cross sectional area that the second end of the bypass-passage.

8. The turbine assembly of claim 1, wherein the bypass-passage includes at least one non-linear section.

9. The turbine assembly of claim 1, further comprising a plurality of bypass-passages.

10. The turbine assembly of claim 1, configured as a gas turbine.

11. The turbine assembly of claim 1, wherein the base member is a vane root wherein the bypass-passage extends through the vane root.

12. The turbine assembly of claim 1, configured as an impulse type steam turbine.

13. The turbine assembly of claim 12, wherein the base member comprises a diaphragm configured and arranged as a support ring for the stationary vanes of the stationary vane row wherein bypass-passage extends through a steam turbine diaphragm.

14. The turbine assembly of claim 12, wherein the base member comprises a diaphragm configured and arranged as a support ring for the stationary vanes of the stationary vane row wherein the bypass-passage extends around the diaphragm.

15. The turbine assembly of claim 13, wherein the diaphragm includes:

a first extension ring extending between the first shroud and the casing wherein the first sealing means is mounted on the extension ring between the extension ring and the first shroud; and a second extension ring extending between the second shroud and the casing wherein the second sealing means is mounted on the second extension ring between the second extension ring and the first shroud.

* * * * *